US007535318B2

(12) United States Patent
Takubo et al.

(10) Patent No.: US 7,535,318 B2
(45) Date of Patent: May 19, 2009

(54) DIELECTRIC DEVICE

(75) Inventors: Osamu Takubo, Tokyo (JP); Kouji Tashiro, Tokyo (JP); Kazuyoshi Terao, Tokyo (JP)

(73) Assignee: TDK Corporation, Tokyo (JP)

( * ) Notice: Subject to any disclaimer, the term of this patent is extended or adjusted under 35 U.S.C. 154(b) by 225 days.

(21) Appl. No.: 11/546,252

(22) Filed: Oct. 12, 2006

(65) Prior Publication Data

US 2007/0085628 A1 Apr. 19, 2007

(30) Foreign Application Priority Data

Oct. 13, 2005 (JP) ..... 2005-299173

(51) Int. Cl.
*H01P 1/20* (2006.01)
*H01P 3/06* (2006.01)

(52) U.S. Cl. ..... 333/132; 333/202; 333/206

(58) Field of Classification Search ..... 333/132, 333/202, 206, 207
See application file for complete search history.

(56) References Cited

U.S. PATENT DOCUMENTS

| | | | | |
|---|---|---|---|---|
| 5,045,824 | A | 9/1991 | Metroka | |
| 5,218,329 | A * | 6/1993 | Vangala et al. | 333/206 |
| 5,760,666 | A | 6/1998 | Tada et al. | |
| 5,831,497 | A * | 11/1998 | Yorita et al. | 333/202 |
| 6,229,410 | B1 * | 5/2001 | Lee et al. | 333/206 |
| 6,549,101 | B2 * | 4/2003 | Gotoh et al. | 333/202 |
| 6,570,473 | B2 | 5/2003 | Endo et al. | |
| 6,680,661 | B2 * | 1/2004 | Hiroshima et al. | 333/134 |
| 6,727,784 | B2 | 4/2004 | Endou et al. | |
| 6,737,943 | B2 | 5/2004 | Takubo et al. | |
| 6,844,796 | B2 * | 1/2005 | Taki et al. | 333/206 |
| 6,885,261 | B2 * | 4/2005 | Atokawa et al. | 333/134 |

FOREIGN PATENT DOCUMENTS

| | | |
|---|---|---|
| EP | 1 298 758 B1 | 4/2003 |
| JP | 5-97105 | 12/1993 |
| JP | 7-79104 | 3/1995 |
| JP | 8-32314 | 2/1996 |

(Continued)

OTHER PUBLICATIONS

U.S. Appl. No. 11/523,603, filed Sep. 20, 2006, Takubo, et al.

(Continued)

*Primary Examiner*—Benny Lee
*Assistant Examiner*—Kimberly E Glenn
(74) *Attorney, Agent, or Firm*—Oblon, Spivak, McClelland, Maier & Neustadt, P.C.

(57) ABSTRACT

A dielectric device includes a dielectric substrate, a plurality of resonator units, and first and second terminals. The dielectric substrate has an external conductor film thereon. Each of the resonator units has a hole and an internal conductor provided inside the hole and connecting with the external conductor film. The first terminal is provided on the dielectric substrate and electrically coupled with at least one of the resonator units. The second terminal is provided on the dielectric substrate and electrically coupled with at least another of the resonator units. An intermediate conductor film, which is a part of the external conductor film, is provided between the first and second terminals. The intermediate conductor film has an insulating film thereon.

8 Claims, 20 Drawing Sheets

FOREIGN PATENT DOCUMENTS

| | | |
|---|---|---|
| JP | 9-64612 | 3/1997 |
| JP | 9-162608 | 6/1997 |
| JP | 10-93311 | 4/1998 |
| JP | 10-190311 | 7/1998 |
| JP | 10-190312 | 7/1998 |
| JP | 10-308608 | 11/1998 |
| JP | 2000-101306 | 4/2000 |
| JP | 2000-196309 | 7/2000 |
| JP | 2001-94304 | 4/2001 |
| JP | 3329450 | 7/2002 |
| JP | 2003-110306 | 4/2003 |

OTHER PUBLICATIONS

U.S. Appl. No. 11/546,252, filed Oct. 12, 2006, Takubo, et al.

* cited by examiner

DIELECTRIC DEVICE

BACKGROUND OF THE INVENTION

1. Field of the Invention

The present invention relates to a dielectric device such as a dielectric filter or a duplexer and an electronic device using the same.

2. Description of the Related Art

Such dielectric devices are used in a high-frequency range such as sub-microwave band, microwave band, millimeter wave band, or sub-millimeter wave band. More specific examples of applications include satellite communication devices, mobile communication devices, wireless communication devices, high-frequency communication devices, or base stations for such communication devices.

Conventionally, resonators and dielectric filters used in portable phones and the like have been constructed by combining a plurality of resonating units each formed by providing one through-hole in a dielectric substrate, wherein the resonator length is generally determined by dividing a quarter of a wavelength λ of a free space by the square root of a relative dielectric constant of a material constituting the dielectric substrate.

Such a dielectric filter may be constructed by either connecting a plurality of resonators through a separately prepared coupling circuit or providing a generally rectangular parallelepiped-shaped dielectric substrate with a plurality of through-holes extending from one side to the opposite side, wherein the through-holes are fashioned into resonating units by metalizing five external surfaces of the dielectric substrate and inner walls of the through-holes.

In the case of using a dielectric substrate for the dielectric filter, an additional component may be added by providing an additional element such as a capacitor to the resonating unit or forming a conductive pattern on the non-metalized external surface. Furthermore, a groove or recess may be formed in the dielectric substrate itself to intentionally upset the balance of electromagnetic coupling distribution for achieving electric field or magnetic field coupling.

Each of the resonator units may be provided with first and second terminals, which may serve as input/output terminals. Typically, the first and second terminals are disposed on a surface intended to face a circuit board.

When the dielectric device is mounted with the first and second terminals facing the circuit board, however, although most of an external conductor film connects with an earthing conductor on the circuit board through a solder or the like, electrical coupling between the earthing conductor and an intermediate conductor film, which is a part of the external conductor film, shifts an attenuation pole, resulting in fluctuation of pass band width and other filter characteristics.

As an effective means to solve the problems of miniaturization and height reduction, Japanese Patent No. 3329450 discloses a novel dielectric device whose resonator unit is composed of a first hole and a second hole meeting one end of the first hole. However, this prior art document also fails to disclose a means to solve the above problems.

SUMMARY OF THE INVENTION

It is an object of the present invention to provide a dielectric device which ensures easy adjustment of filter characteristics such as attenuation pole and pass band width.

It is another object of the present invention to provide a dielectric device which has filter characteristics such as pass band width improved by shifting a high-frequency attenuation pole closer to a low-frequency side while hardly shifting a low-frequency attenuation pole.

In order to achieve the above objects, the present invention provides dielectric devices of three embodiments and an electronic device constructed by incorporating any one of the dielectric devices into a circuit board. The dielectric device may be a dielectric filter or a duplexer.

According to a first aspect, the dielectric device comprises a dielectric substrate, a plurality of resonator units, and first and second terminals. The dielectric substrate has an external conductor film thereon. Each of the resonator units has a hole and an internal conductor provided inside the hole and connecting with the external conductor film.

The first terminal is provided on the dielectric substrate and electrically coupled with at least one of the resonator units, while the second terminal is provided on the dielectric substrate and electrically coupled with at least another of the resonator units. An intermediate conductor film, which is a part of the external conductor film, is provided between the first and second terminals.

The above configuration has been well known in the art. The first aspect of the present invention is characterized in that the intermediate conductor film has an insulating film thereon.

With this configuration, although most of the external conductor film connects with an earthing conductor on a circuit board through a solder or the like when the dielectric device is mounted with the first and second terminals facing the circuit board, the insulating film ensures separation of the intermediate conductor film from the earthing conductor. Therefore, filter characteristics such as pass band width can be adjusted by generating a sharp attenuation pole at a high-frequency side while hardly shifting a low-frequency attenuation pole. It is also possible to adjust an attenuation pole frequency by changing the relative length of the insulating film to the terminal.

According to a second aspect, the dielectric device comprises a dielectric substrate, a plurality of resonator units, and first and second terminals. The dielectric substrate has an external conductor film thereon. Each of the resonator units has first and second holes.

The first hole is provided in the dielectric substrate, opens on a first external surface of the dielectric substrate, extends toward a second external surface of the dielectric substrate opposite to the first external surface, and has a first internal conductor therein. The second hole is provided in the dielectric substrate, opens on a third external surface of the dielectric substrate not opposite to the first external surface, connects with the first hole inside the dielectric substrate, and has a second internal conductor therein. The second internal conductor connects with the first internal conductor inside the dielectric substrate.

The first terminal is provided on the dielectric substrate and electrically coupled with at least one of the resonator units, while the second terminal is provided on the dielectric substrate and electrically coupled with at least another of the resonator units.

An intermediate conductor film, which is a part of the external conductor film, is provided between the first and second terminals.

The above configuration has been well known as disclosed in Japanese Patent No. 3329450. The second aspect of the present invention is characterized in that the intermediate conductor film has an insulating film thereon.

With this configuration, although most of the external conductor film connects with an earthing conductor on a circuit board through a solder or the like when the dielectric device is mounted with the first and second terminals facing the circuit board, the insulating film ensures separation of the intermediate conductor film from the earthing conductor. Therefore, filter characteristics such as pass band width can be adjusted by generating a sharp attenuation pole at a high-frequency side while hardly shifting a low-frequency attenuation pole. It is also possible to adjust an attenuation pole frequency by changing the relative length of the insulating film to the terminal.

In case of having first to third terminals, such as in a duplexer, the insulating film may be provided on each intermediate conductor film lying between adjacent terminals.

A dielectric device according to a third aspect has the same basic structure as the dielectric device according to the second aspect, but is characterized in that the intermediate conductor film is thinner than the first and second terminals to have a difference in surface level. With this configuration, although most of the external conductor film connects with an earthing conductor on a circuit board through a solder or the like when the dielectric device is mounted with the first and second terminals facing the circuit board, the difference in surface level between the intermediate conductor film and the first and second terminals ensures separation of the intermediate conductor film from the earthing conductor. Therefore, a sharp attenuation pole can be generated at a high-frequency side while hardly shifting a low-frequency attenuation pole. It is also possible to adjust an attenuation pole frequency.

The third aspect can be realized only by forming the first and second terminals to be thicker than the external conductor film, which does not cause any difficulty in manufacturing.

According to the present invention, an electronic device can be obtained by combining any one of the above dielectric devices and a circuit board. It will be appreciated that the above effects and advantages can also be obtained from such combinations.

Such an electronic device may also be obtained, without limited to the above dielectric devices of the present invention, by adapting the circuit board to have the same function as the above dielectric devices. That is, the insulating film may be formed on a portion of the circuit board which is intended to face the intermediate conductor film of the dielectric device, instead of directly on the intermediate conductor film of the dielectric device. This also ensures the above effects and advantages.

As described above, the present invention has at least one of the following advantages:

(a) Providing a dielectric device which ensures easy adjustment of filter characteristics such as attenuation pole and pass band width; and (b) Providing a dielectric device which has filter characteristics such as pass band width improved by shifting a high-frequency attenuation pole closer to a low-frequency side while hardly shifting a low-frequency attenuation pole.

The present invention will be more fully understood from the detailed description given hereinbelow and the accompanying drawings which are given by way of illustration only, and thus are not to be considered as limiting the present invention.

DESCRIPTION OF THE PREFERRED EMBODIMENTS

Figure 1:
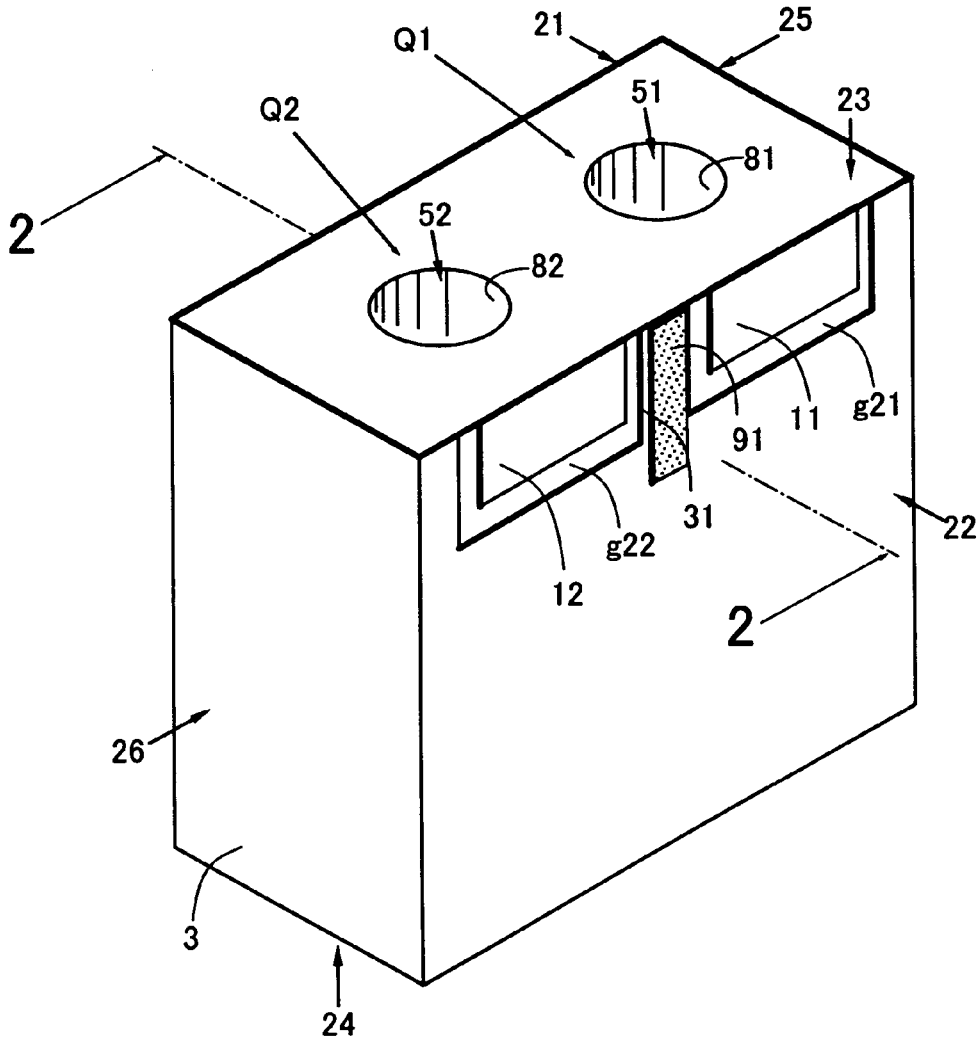
FIG. 1 is a perspective view of a dielectric device according to one embodiment of the present invention.
Figure 2:
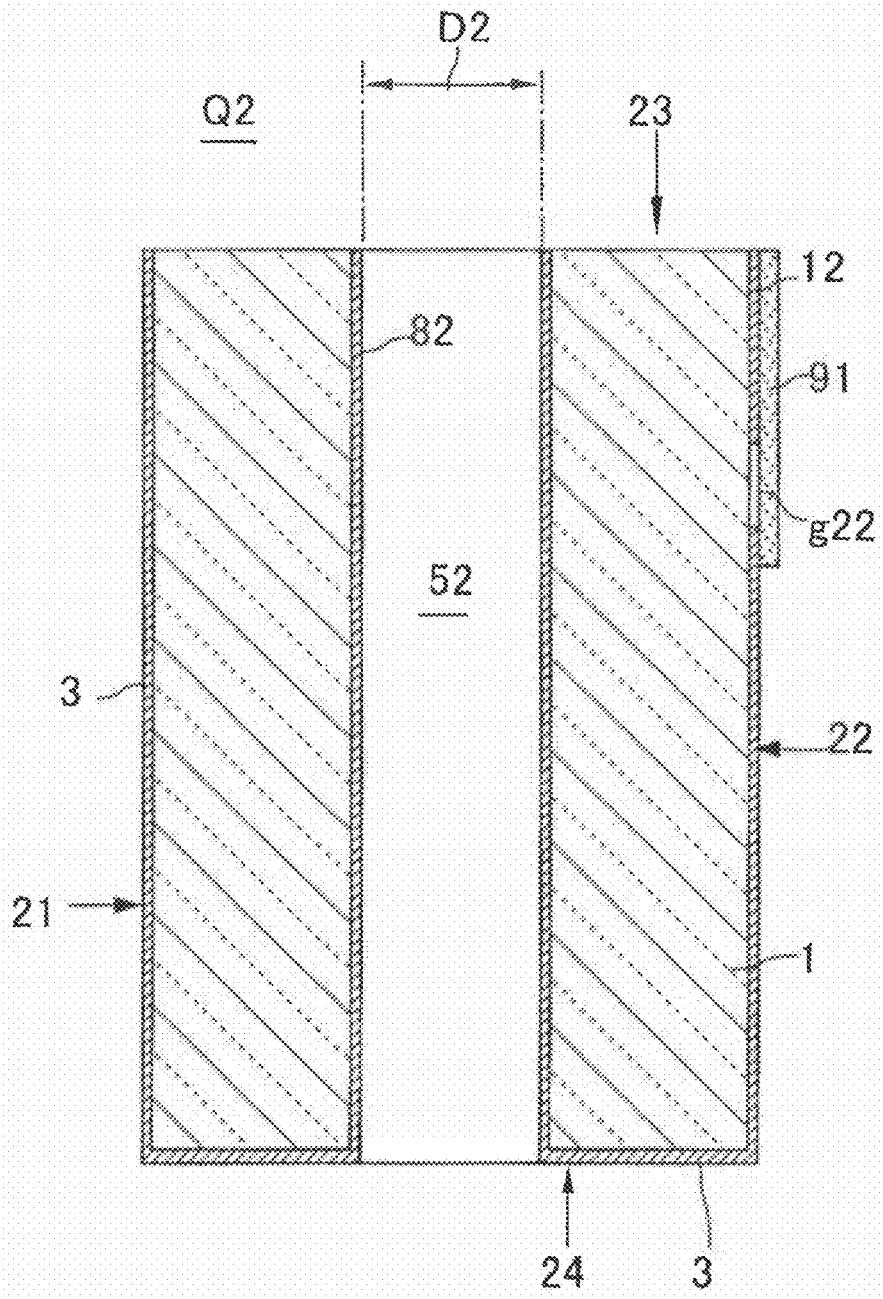
FIG. 2 is a cross-sectional view taken along line 2-2 in FIG. 1.
Figure 3:
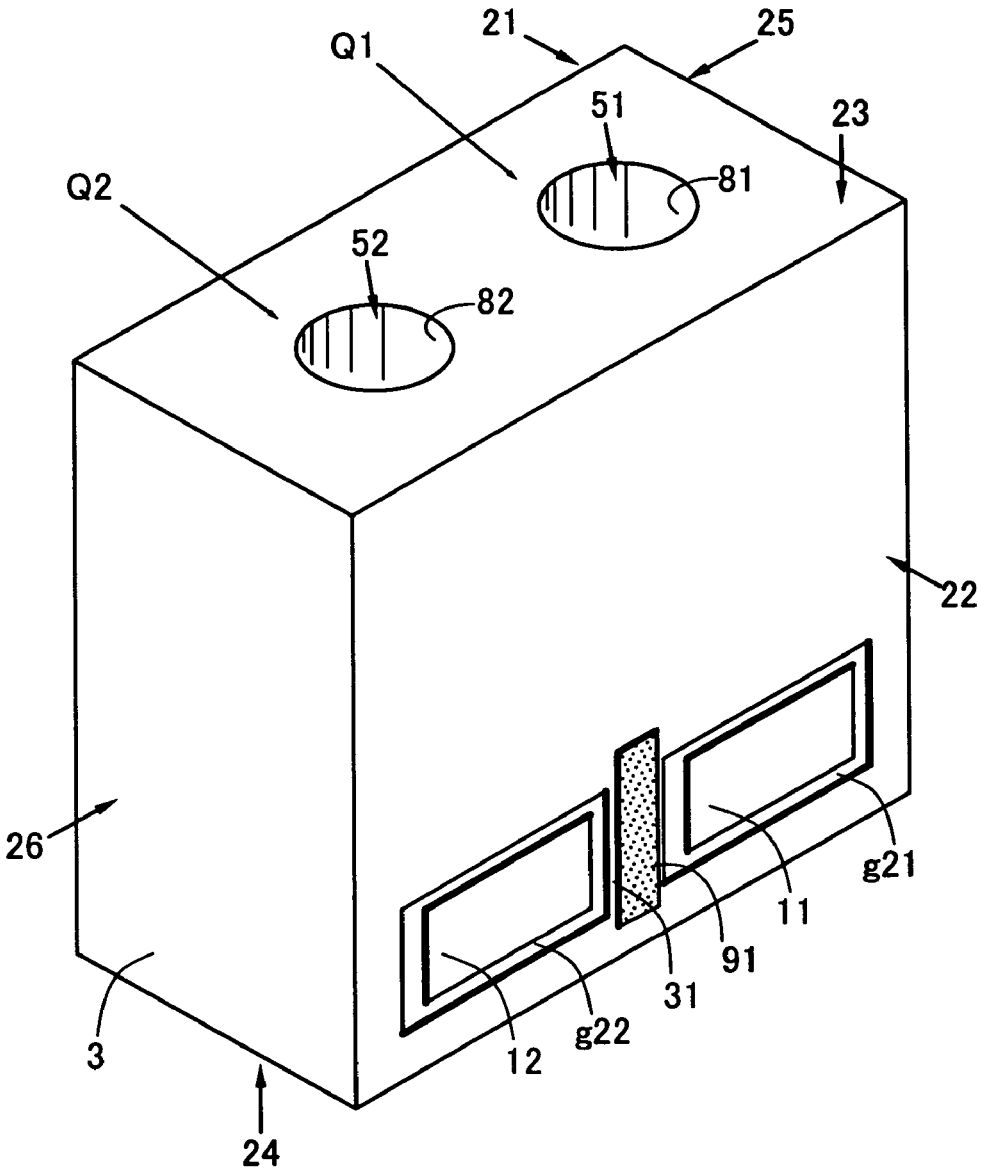
FIG. 3 is a perspective view of a dielectric device according to another embodiment of the present invention.
Figure 4:
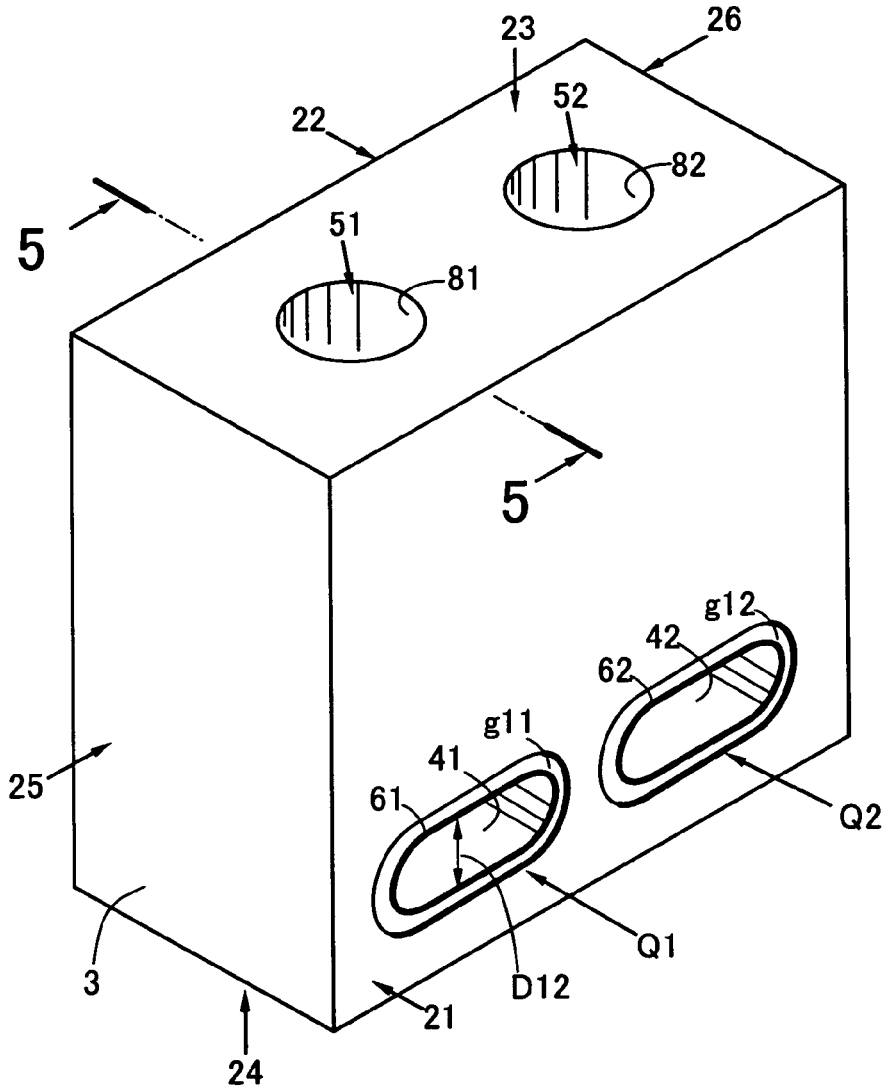
FIG. 4 is a perspective view of the dielectric device shown in FIG. 3, as seen from a rear side thereof.

Referring to FIGS. 1 and 2, a dielectric device according to a first embodiment of the present invention includes a dielectric substrate 1 and two resonator units Q1, Q2. The dielectric substrate 1 is formed from a well-known dielectric ceramic to have a generally hexahedral shape with first to sixth external surfaces 21 to 26. Typically, an external conductor film 3 may be formed by baking, plating or the like to contain copper, silver or the like as a main component.

The resonator unit Q1 includes a hole 51. The hole 51 opens on the third and fourth surfaces 23, 24 with an internal conductor 81 therein. The internal conductor 81 connects with the external conductor film 3 at one end opening on the fourth external surface 24. Alternatively, the internal conductor 81 may be formed by filling a part or the whole of the hole 51.

The resonator unit Q2, which has substantially the same configuration as the resonator unit Q1, includes a hole 52. Since the resonator unit Q2 has the same configuration as the resonator unit Q1, the explanation about the effects and advantages of the resonator unit Q1 is applicable to the resonator unit Q2. Concerning the effects of the whole dielectric device, furthermore, the coupling between the resonator units Q1, Q2 should be considered.

The second external surface 22 of the dielectric substrate 1 is provided with first and second terminals 11, 12, which may serve as input/output terminals. The first terminal 11 is opposed to the hole 51 and electrically isolated from the external conductor film 3 by an isolating gap g21. The second terminal 12 is opposed to the hole 52 and electrically isolated from the external conductor film 3 by an isolating gap g22.

Between the first and second terminals 11, 12 and the internal conductors 51, 52, there is generated a coupling capacitance that depends on the thickness, dielectric constant and area of the dielectric layer. Between the first and second terminals 11, 12, there is provided an intermediate conductor film 31, which is a part of the external conductor film 3.

The above configuration has been well known in the art. The first embodiment of the present invention is characterized in that the intermediate conductor film 31 has an insulating film 91 thereon. The effects and advantages thereof will be described hereinbelow with reference to FIGS. 7 to 11. Examples of the insulating film 91 include a glass film, a solder resist film, an organic insulating film, and an inorganic insulating film. These films can be formed by using a simple coating method and therefore are highly suitable for mass production.

Referring to FIGS. 3 to 6, a dielectric device according to a second embodiment of the present invention includes a dielectric substrate 1 and two resonator units Q1, Q2. The dielectric substrate 1 is formed from a well-known dielectric ceramic to have a generally hexahedral shape with first to sixth external surfaces 21 to 26. Typically, an external conductor film 3 may be formed by baking, plating or the like to contain copper, silver or the like as a main component.

The resonator unit Q1 includes first and second holes 41, 51. The first hole 41 is provided in the dielectric substrate 1 and extends from the first external surface 21 toward the opposite second external surface 22 with one end opening on the first external surface 21. The first hole 41 has a first internal conductor 61 therein. The first internal conductor 61 may be formed as an electrode film from the same material and by the same means as the external conductor film 3. Alternatively, the first internal conductor 61 may be formed by filling a part or the whole of the first hole 41. The first internal conductor 61 is separated from the external conductor film 3 on the first external surface 21 by a gap g11.

The second hole 51 is also provided in the dielectric substrate 1 and extends from the third external surface 23 toward the opposite fourth external surface 24 with one end opening on the third external surface 23. The other end of the second hole 51 is connected to the first hole 41 inside the dielectric substrate 1.

The second hole 51 has a second internal conductor 81 therein. The second internal conductor 81 has one end connected to the external conductor film 3 on the third surface 23 and the other end connected to the first internal conductor 61. The second internal conductor 81 may be formed from the same material and by the same means as the first internal conductor 61. Alternatively, the second internal conductor 81 may be formed by filling a part or the whole of the second hole 51.

In the illustrated embodiment, the second hole 51 is of a substantially circular shape with an inner diameter D2. The first hole 41 is of a generally rectangular shape, of which an inner diameter D11 along the width direction is larger than an inner diameter D12 along the length direction. The inner diameter D11 along the width direction is larger than the inner diameter D2 of the second hole 51. Therefore, the second hole 51 is connected to the first hole 41 with its inside end within the width of the first hole 41. The first hole 41 preferably has rounded corners. Although D11 is larger than D12 in the illustrated embodiment, D12 may be equal to or larger than D11. In the illustrated embodiment, furthermore, the first hole 41 extends a distance X1 along the depth direction beyond a junction with the second hole 51 (see FIG. 5).

The resonator unit Q2, which has substantially the same configuration as the resonator unit Q1, includes first and second holes 42, 52. Since the resonator unit Q2 has the same configuration as the resonator unit Q1, the explanation about the effects and advantages of the resonator unit Q1 is applicable to the resonator unit Q2. Concerning the effects of the whole dielectric device, furthermore, the coupling between the resonator units Q1, Q2 should be considered.

Whether the coupling between the resonator units Q1, Q2 is a capacitive coupling or an inductive coupling depends on the relative relationship between two capacitances: one being a capacitance formed between the internal conductor 61 of the first hole 41 and the internal conductor 62 of the first hole 42; the other being a capacitance formed between the external conductor film 3 and the internal conductors 61, 62 of the first holes 41, 42. When the former is stronger, the coupling between the resonator units Q1, Q2 is predominantly capacitive, and when the latter is stronger, the coupling is predominantly inductive.

The second external surface 22 of the dielectric substrate 1 is provided with first and second terminals 11, 12, which may serve as input/output terminals. The first terminal 11 is opposed to the first hole 41 and electrically isolated from the external conductor film 3 by an isolating gap g21. The second terminal 12 is opposed to the first hole 42 and electrically isolated from the external conductor film 3 by an isolating gap g22.

Between the first and second terminals 11, 12 and the internal conductors 61, 62 of the first holes 41, 42, there is generated a coupling capacitance that depends on the thickness, dielectric constant and area of the dielectric layer. The first and second terminals 11, 12 are not required to coincide with the internal conductors 61, 62 of the first holes 41, 42. For example, the first and second terminals 11, 12 may partially face or may not face the internal conductors 61, 62 of the first holes 41, 42. Between the first and second terminals 11, 12, there is provided an intermediate conductor film 31, which is a part of the external conductor film 3.

In the resonator unit Q1, as described above, the first hole 41 extends from the first external surface 21 toward the opposite second external surface 22 with one end opening on the first external surface 21. The second hole 51 extends from the third external surface 23 toward the opposite fourth external surface 24 with one end opening on the third external surface 23. The other end of the second hole 51 is connected to the first hole 41 inside the dielectric substrate 1.

In this hole configuration, since the first internal conductor 61 and the second internal conductor 81 are connected to each other, as described above, the first hole 41 and the second hole 51 constitute one electric circuit. The first internal conductor 61 is opposed to the external conductor film 3 on the second, fourth to sixth external surfaces 22, 24 to 26 across dielectric layers 71 to 74. Consequently, a capacitive coupling is formed between the first internal conductor 61 and the external conductor film 3.

Figure 5:
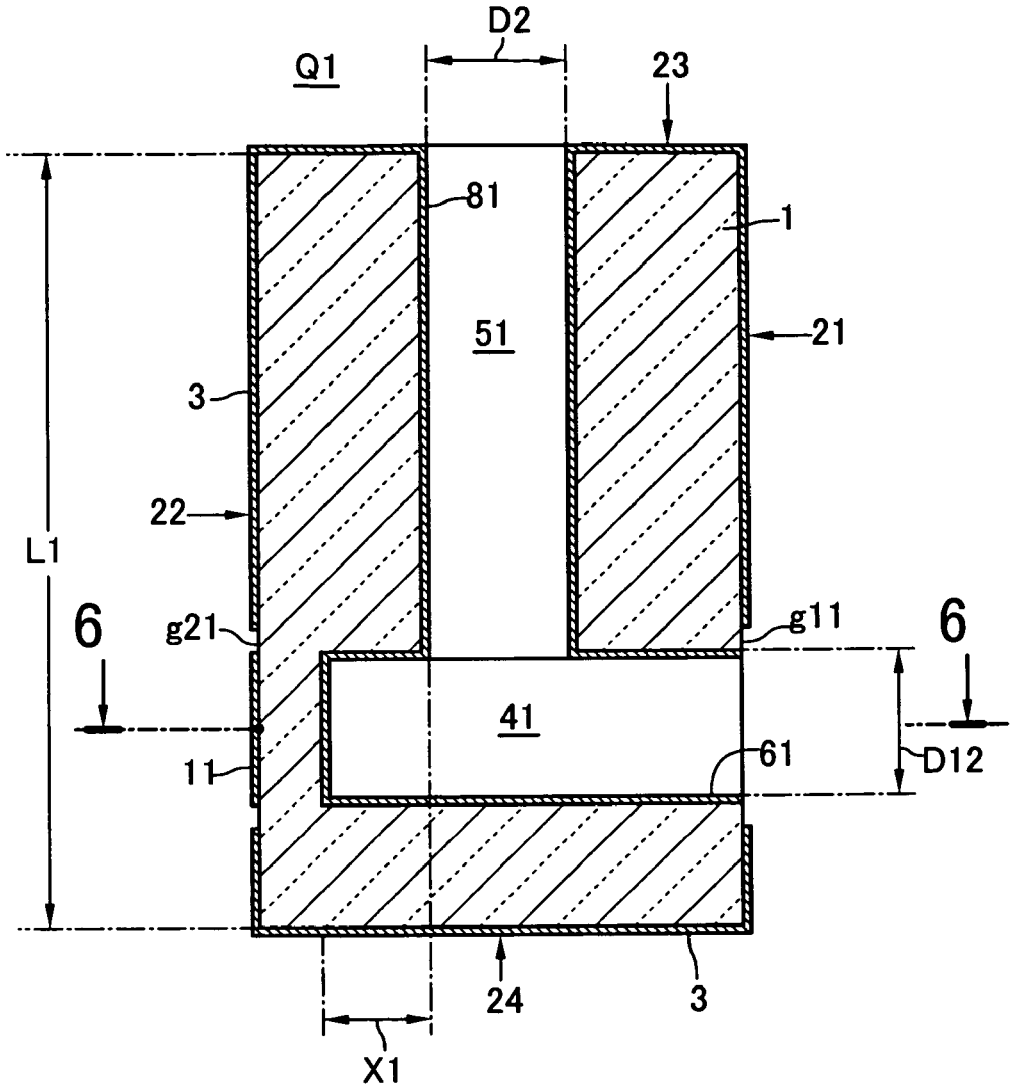
FIG. 5 is a cross-sectional view taken along line 5-5 in FIG. 3.
Figure 6:
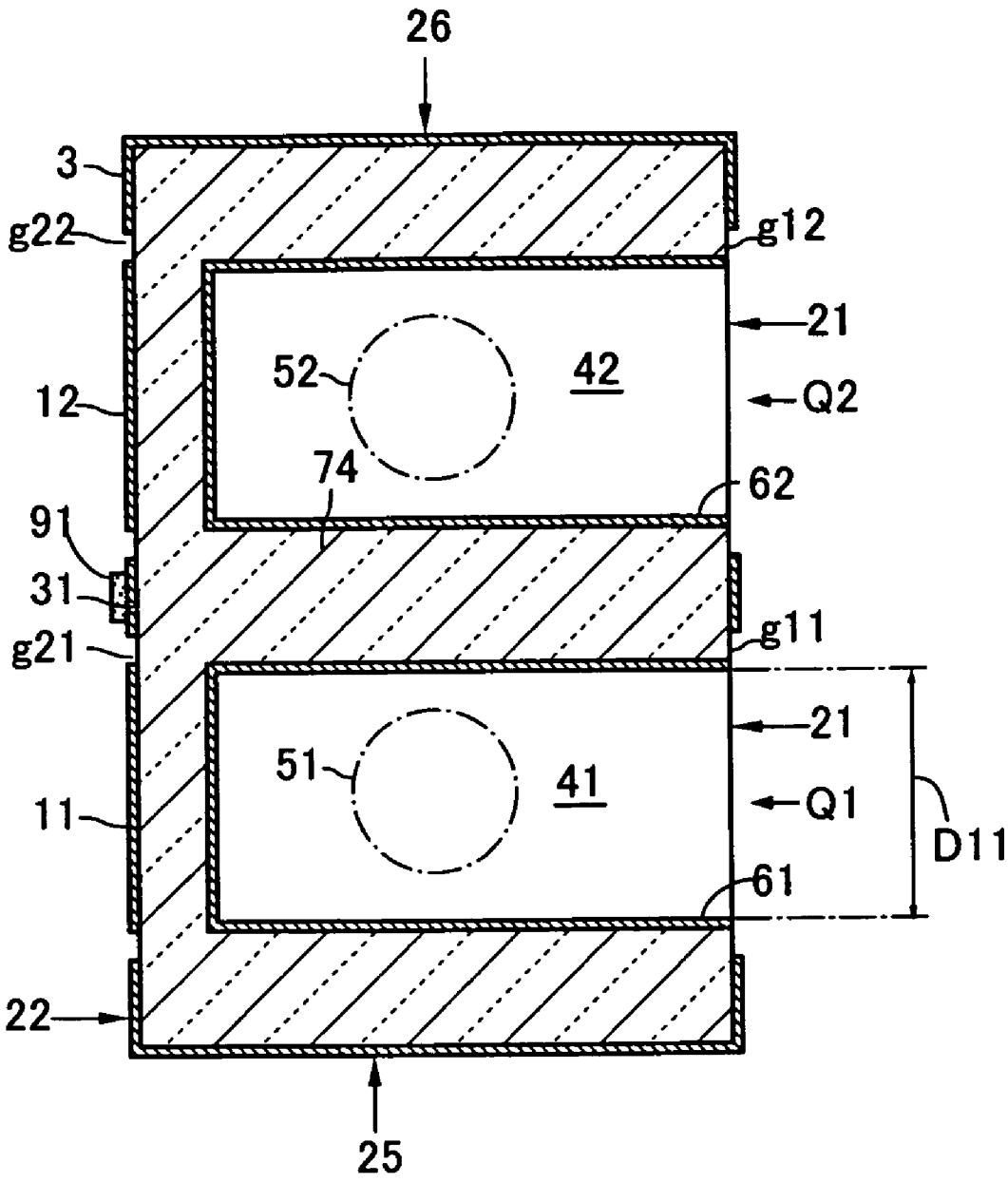
FIG. 6 is a cross-sectional view taken along line 6-6 in FIG. 5.

Since the first internal conductor 61 of the first hole 41 is opposed to the external conductor film 3 across the dielectric substrate 1, as described above, large electrostatic capacitances are formed between the first internal conductor 61 and the external conductor film 3 (see FIGS. 5 and 6). Therefore, the dielectric device according to the second embodiment of the present invention resonates at a frequency that is less than the electrical length of the dielectric substrate 1 having a length L1 along the axial direction of the second hole 51. In other words, miniaturization and height reduction can be achieved by shortening the length L1 of the dielectric substrate 1 in order to obtain a desired resonant frequency.

Next, a specific example will be given to describe miniaturization and height reduction of the dielectric device according to the second embodiment. The specific example was prepared in accordance with the configuration of the dielectric device illustrated in FIGS. 3 to 6. The dielectric substrate 1 was formed from a dielectric material of a relative dielectric constant $\in r=92$ into a generally rectangular parallelepiped shape. The external dimensions of the dielectric substrate 1 were such that the plane area of the third external surface 23 was (2 mm×2 mm) and the length L1 was 2.5 mm. The inner diameter D2 of the second hole 51 was 0.5 mm, and the inner diameter D11 of the first hole 41 was 1 mm.

When measured in a loosely coupled state, this dielectric device had a resonant frequency of 2.02 GHz. This means that the dielectric device according to the second embodiment can shorten the length L1 by about 30% as compared with conventional quarter-wavelength resonators with a resonant frequency of 2.02 GHz in which the length L1 needs to be about 3.5 to 4 mm.

The above configuration and its effects and advantages have been well known as disclosed in Japanese Patent No. 3329450. The second embodiment of the present invention is also characterized in that the intermediate conductor film 31 has an insulating film 91 thereon.

Figure 7:
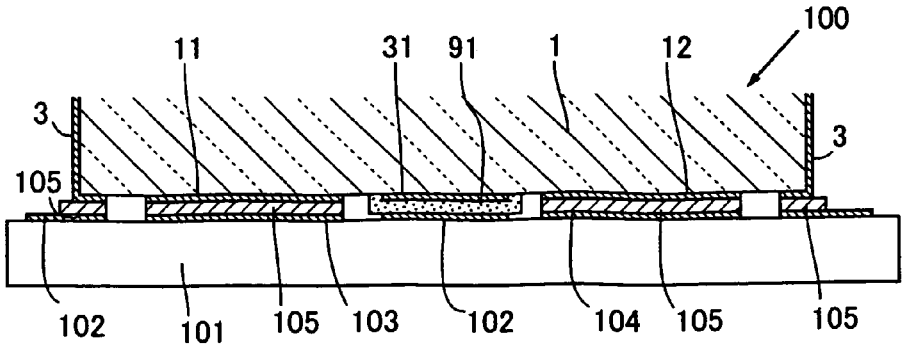
FIG. 7 is a diagram showing use (i.e., a mounted state to a circuit board) of the dielectric devices shown in FIGS. 1 to 6.

With the insulating film 91 on the intermediate conductor film 31, as in the first and second embodiments illustrated in FIGS. 1 to 6, although most of the external conductor film 3 connects with an earthing conductor 102 on a circuit board 101 through a solder 105 or the like when a dielectric device 100 is mounted on the circuit board 101 with the first and second terminals 11, 12 facing the circuit board 101, the insulating film 91 ensures separation of the intermediate conductor film 31 from the earthing conductor 102, as shown in FIG. 7. Therefore, filter characteristics such as pass band width can be adjusted by generating a sharp attenuation pole at a high-frequency side while hardly shifting a low-frequency attenuation pole. It is also possible to adjust an attenuation pole frequency by changing the relative length of the insulating film 91 to the first and second terminals 11, 12. This will be described in detail with reference to experimental data.

As described above, examples of the insulating film 91 include a glass film, a solder resist film, an organic insulating film, and an inorganic insulating film. These films can be formed by using a simple coating method and therefore are highly suitable for mass production. It should be noted that the first and second terminals 11, 12 are connected to conductors 103, 104 on the circuit board 101 through the solder 105.

As understood from the foregoing description, the basic technical idea of the present invention is to separate the intermediate conductor film 31, which is a part of the external conductor film 3, from the earthing conductor 102. Accordingly, it may be embodied in a variety of ways as long as having the above function, for example, as shown in FIGS. 8 and 9 as a third embodiment.

Figure 8:
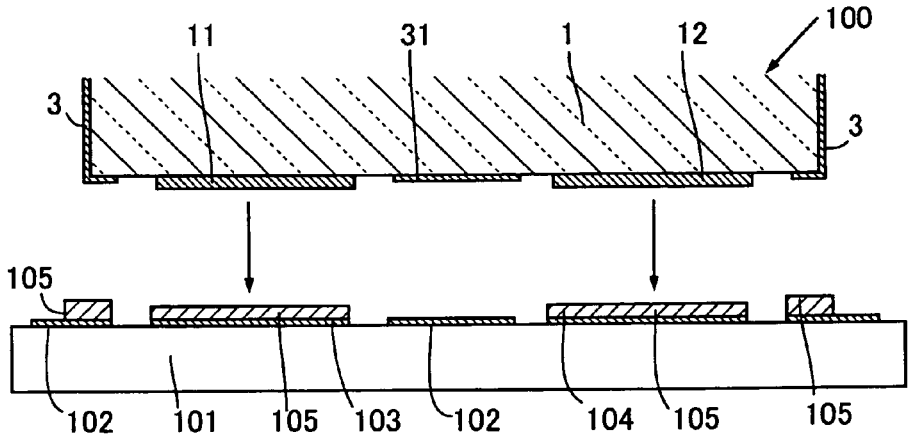
FIG. 8 is a diagram showing a dielectric device according to still another embodiment of the present invention and a process of mounting the dielectric device to a circuit board.
Figure 9:
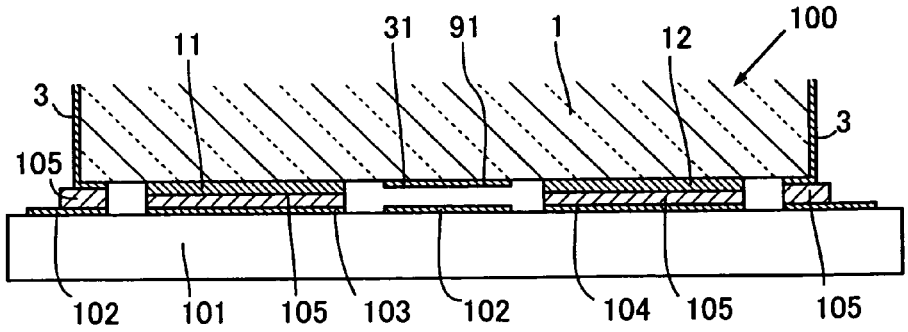
FIG. 9 is a diagram showing a mounted state subsequent to FIG. 8.

Referring first to FIG. 8, the intermediate conductor film 31 is thinner than the first and second terminals 11, 12 to have a difference in surface level. With this configuration, although most of the external conductor film 3 connects with the earthing conductor 102 on the circuit board 101 through the solder or the like when the dielectric device 100 is mounted with the first and second terminals 11, 12 facing the circuit board 101, the difference in surface level between the intermediate conductor film 31 and the first and second terminals 11, 12 ensures separation of the intermediate conductor film 31 from the earthing conductor 102, as shown in FIG. 9. Therefore, a sharp attenuation pole can be generated at a high-frequency side while hardly shifting a low-frequency attenuation pole. It is also possible to adjust an attenuation pole frequency.

Figure 10:
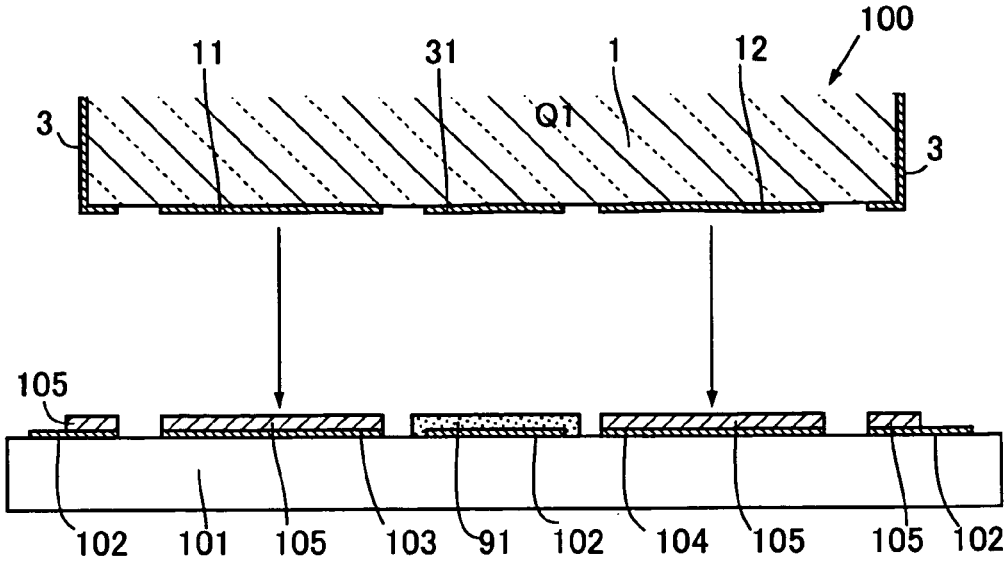
FIG. 10 is a diagram showing a dielectric device according to still another embodiment of the present invention and a process of mounting the dielectric device to a circuit board.
Figure 11:
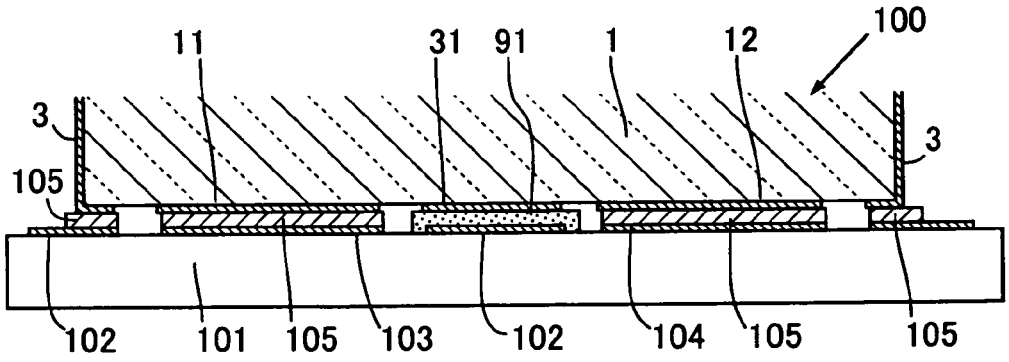
FIG. 11 is a diagram showing a mounted state subsequent to FIG. 10.

The above function can also be achieved by adapting the circuit board, for example, as shown in FIGS. 10 and 11 as still another embodiment. Referring to FIG. 10, a portion of the circuit board 101, which is intended to face the intermediate conductor film 3 when the dielectric device 100 is mounted on the circuit board 101, is covered with an insulating film 91.

With the above configuration, although most of the external conductor film 3 connects with the earthing conductor 102 on the circuit board 101 through the solder 105 or the like when the dielectric device is mounted with the first and second terminals 11, 12 facing the circuit board 101, the insulating film 91 ensures separation of the intermediate conductor film 31 from the earthing conductor 102. Therefore, filter characteristics such as pass band width can be adjusted by generating a sharp attenuation pole at a high-frequency side while hardly shifting a low-frequency attenuation pole. It is also possible to adjust an attenuation pole frequency by changing the relative length of the insulating film 91 to the first and second terminals 11, 12.

Figure 12:
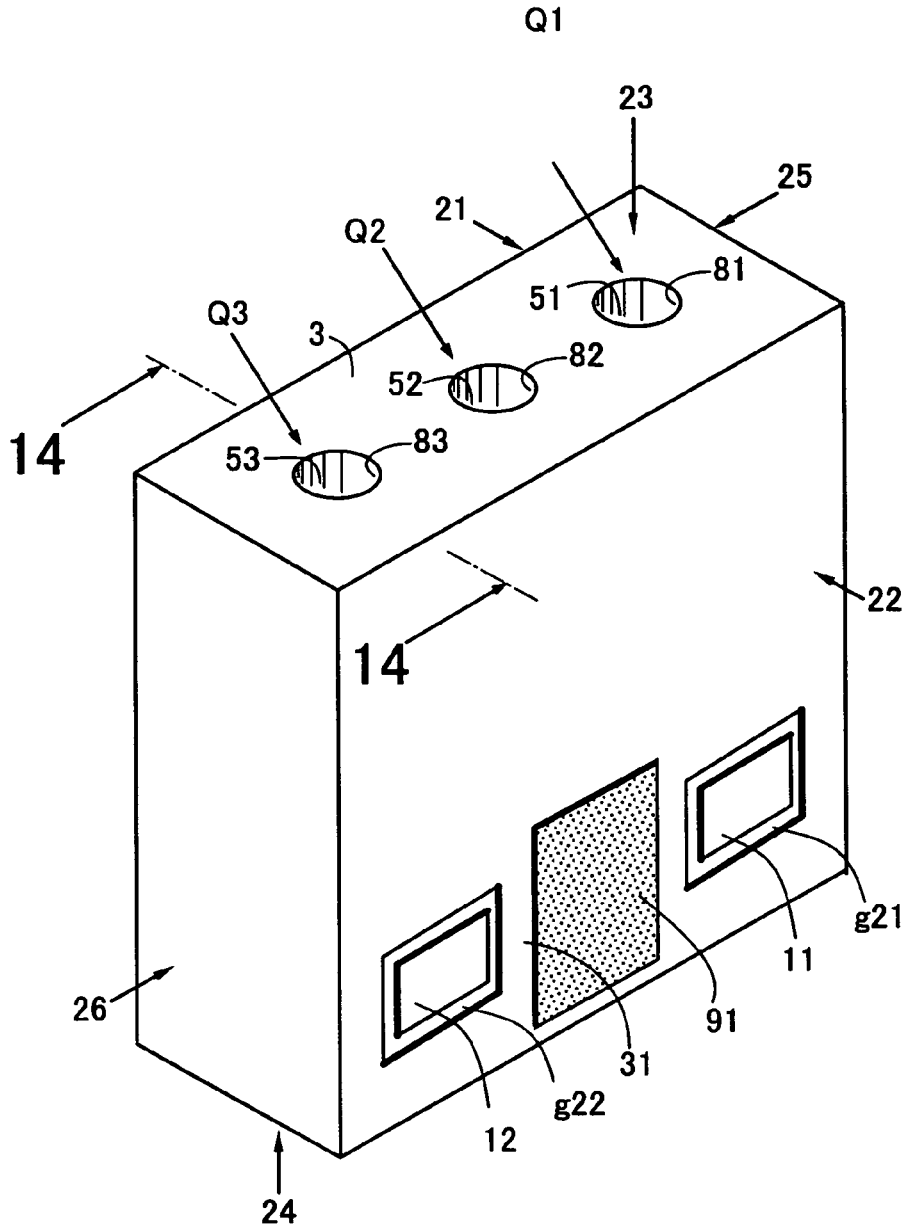
FIG. 12 is a perspective view of a dielectric device with three resonator units.
Figure 13:
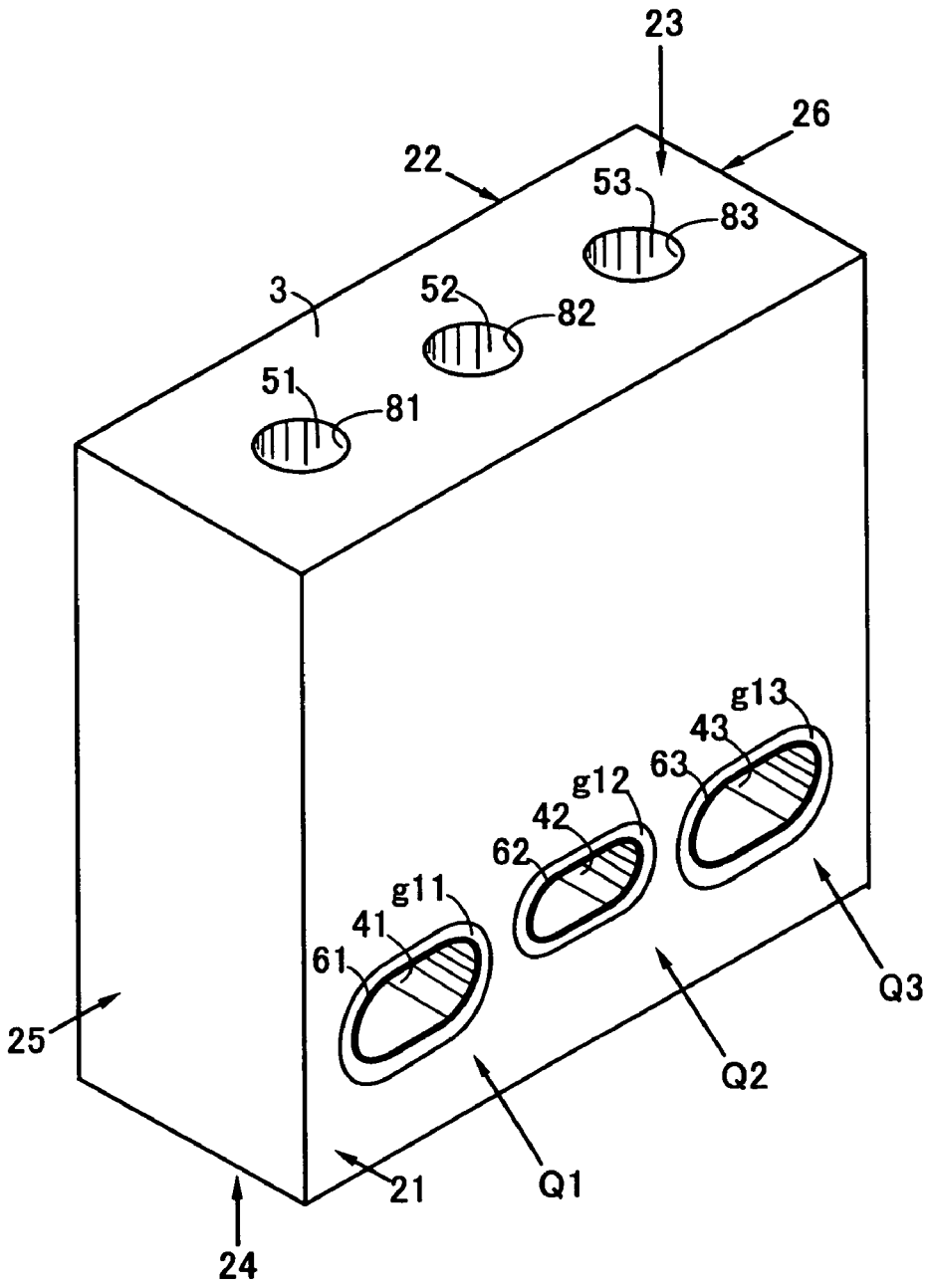
FIG. 13 is a perspective view of the dielectric device shown in FIG. 12, as seen from a rear side thereof.
Figure 14:
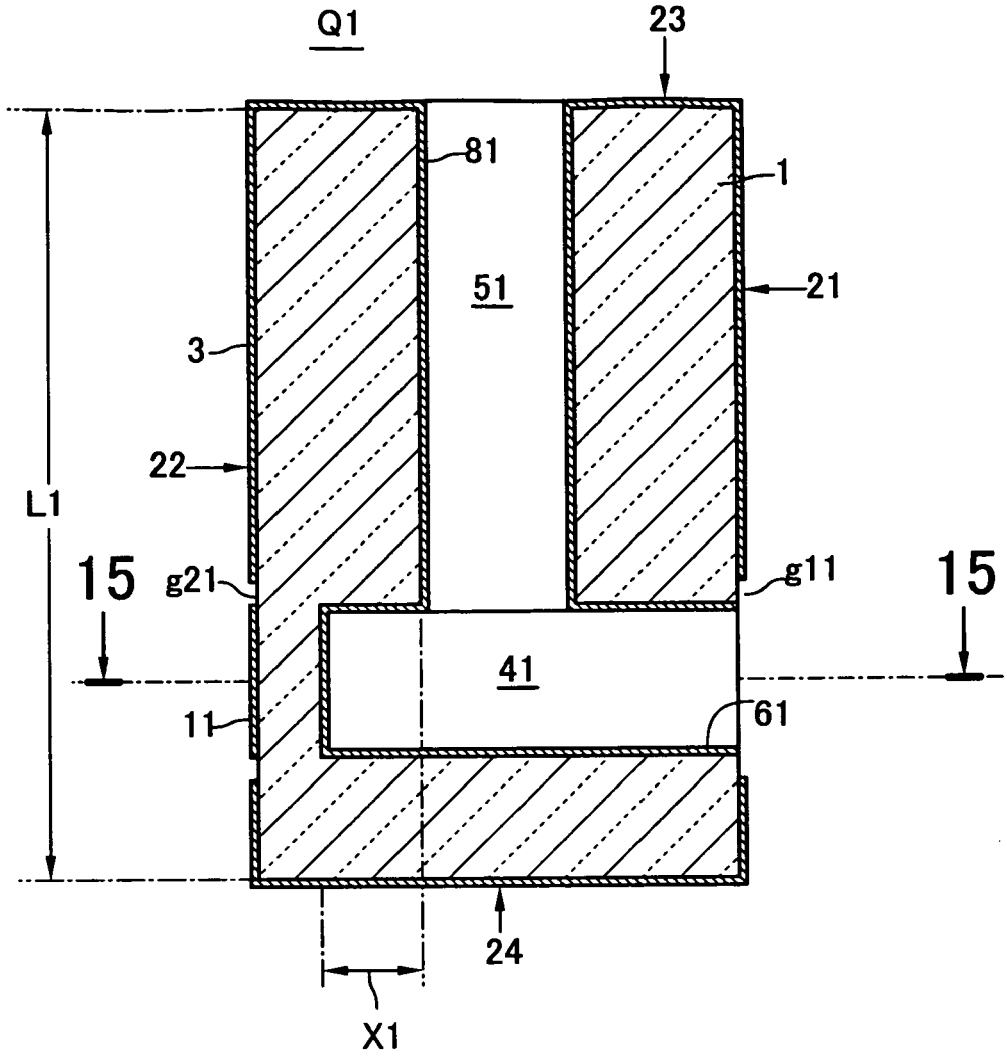
FIG. 14 is a cross-sectional view of the dielectric device shown in FIGS. 12 and 13.
Figure 15:
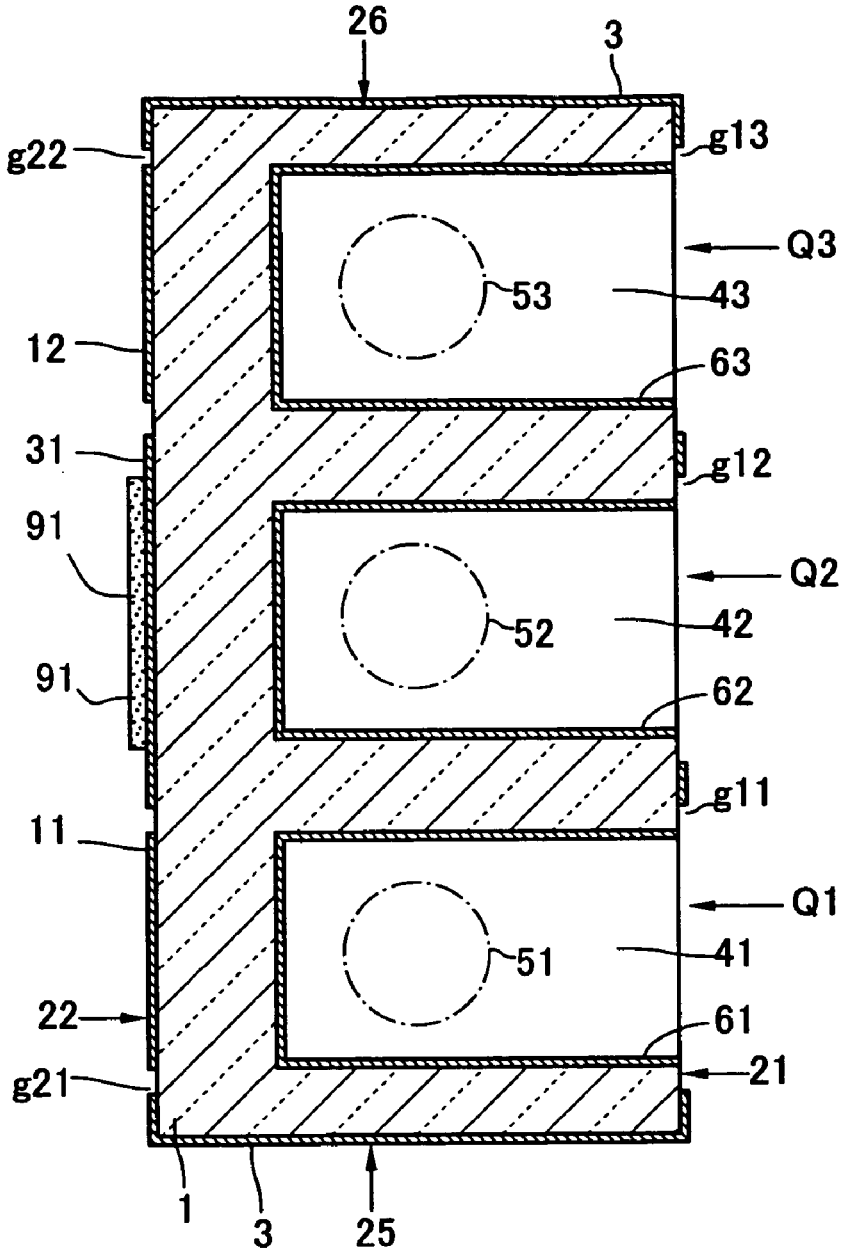
FIG. 15 is a cross-sectional view taken along line 15-15 in FIG. 14.

FIG. 12 is a perspective view of a dielectric device with three resonator units Q1, Q2, Q3; FIG. 13 is a perspective view of the dielectric device shown in FIG. 12, as seen from a rear side thereof; FIG. 14 is a cross-sectional view taken along line 14-14 in FIG. 12; and FIG. 15 is a cross-sectional view taken along line 15-15 in FIG. 14.

The resonator units Q1, Q2, Q3 share a dielectric substrate 1 and are integrated via the dielectric substrate 1.

The resonator unit Q1 includes first and second holes 41, 51. The resonator unit Q2 includes first and second holes 42, 52. The resonator unit Q3 includes first and second holes 43, 53. The first holes 41 to 43 and the second holes 51 to 53 may be configured and related to each other as described above.

The first terminal 11 is provided on the second external surface 22, opposed to the first hole 41, and electrically isolated from the external conductor film 3 by the isolating gap g21. The second terminal 12 is provided on the second external surface 22, opposed to the first hole 43, and electrically isolated from the external conductor film 3 by the isolating gap g22. Between the first and second terminals 11, 12, there is provided an intermediate conductor film 31, which is a part of the external conductor film 3.

With the insulating film 91 on the intermediate conductor film 31, although most of the external conductor film 3 connects with the earthing conductor 102 on the circuit board 101 through the solder 105 or the like when the dielectric device is mounted with the first and second terminals 11, 12 facing the circuit board 101, the insulating film 91 ensures separation of the intermediate conductor film 31 from the earthing conductor 102, as shown in FIG. 7. Therefore, filter characteristics such as pass band width can be adjusted by generating a sharp attenuation pole at a high-frequency side while hardly shifting a low-frequency attenuation pole. It is also possible to adjust an attenuation pole frequency by changing the relative length of the insulating film 91 to the first and second terminals 11, 12.

Figure 16:
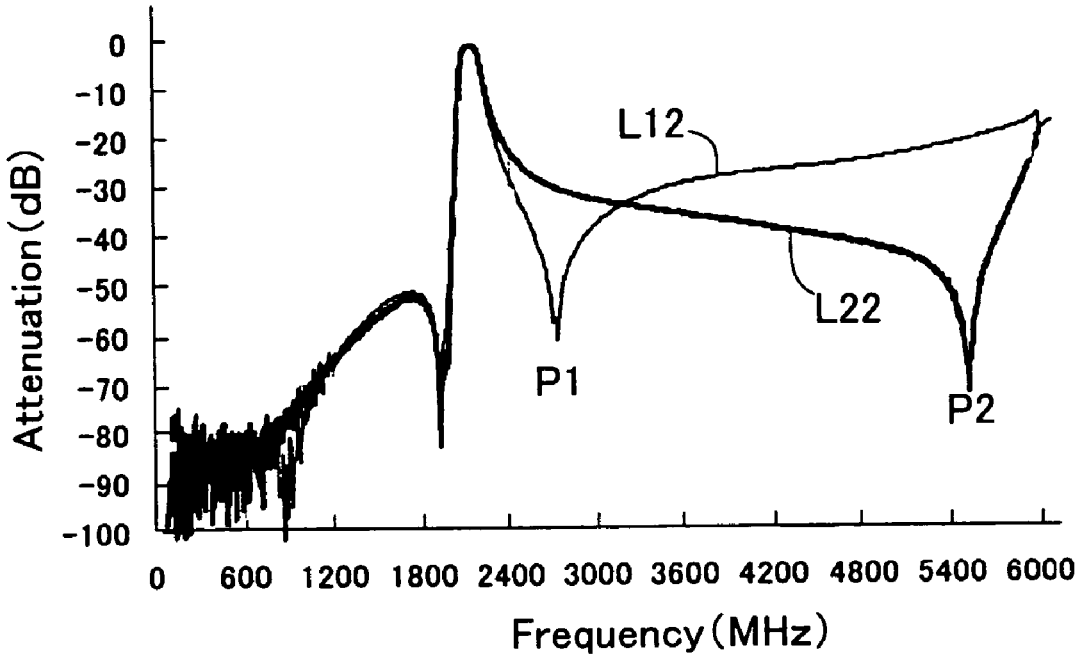
FIG. 16 is a diagram showing frequency attenuation characteristics of dielectric devices having the basic structure shown in FIGS. 12 to 15.

Next, the effects and advantages of the dielectric device according to one embodiment of the present invention will be described with reference to data shown in FIG. 16. FIG. 16 shows frequency attenuation characteristics of dielectric devices (or dielectric filter) having the basic structure shown in FIGS. 12 to 15. In FIG. 16, the curve L12 represents characteristics of a dielectric device provided with the insulating film 91, and the curve L22 represents characteristics of a dielectric device not provided with the insulating film 91.

Referring to FIG. 16, in case of the dielectric device not provided with the insulating film 91, the high-frequency attenuation pole was generated in the vicinity of 5,400 MHz as shown by the curve L22. In case of the dielectric device provided with the insulating film 91, on the other hand, the high-frequency attenuation pole was generated in the vicinity of 2,700 MHz as shown by the curve L12, which means that the insulating film 91 shifted the high-frequency attenuation pole from a place P2 to a lower frequency place P1.

Thus, excellent pass attenuation characteristics can be obtained by generating a high-frequency attenuation pole at a place closer to the pass band without changing a low-frequency attenuation pole in the pass band. Here, the frequency place of the high-frequency attenuation pole may shift closer to the low-frequency side depending on the length, width and material of the insulating film 91.

Figure 17:
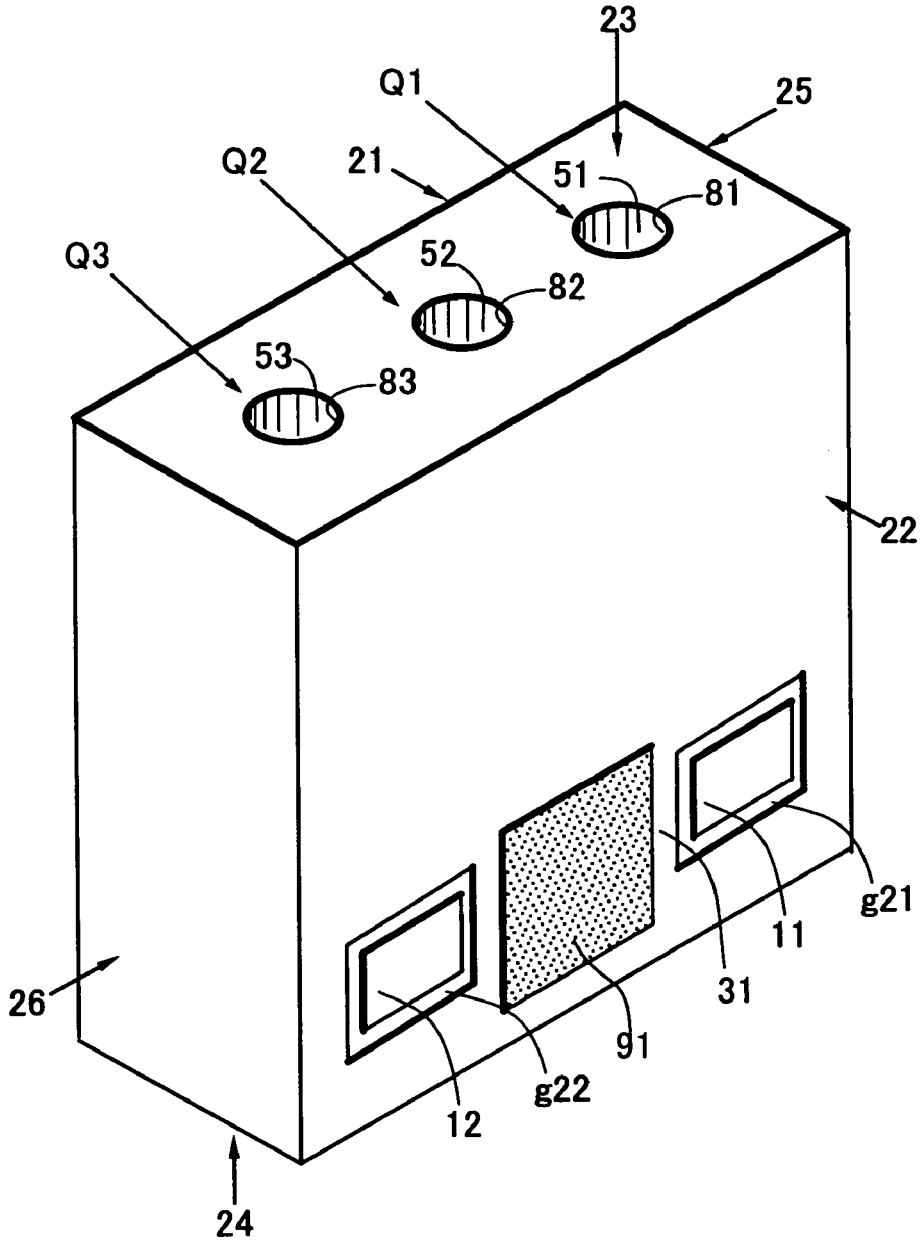
FIG. 17 is a perspective view of a dielectric device according to still another embodiment of the present invention.
Figure 18:
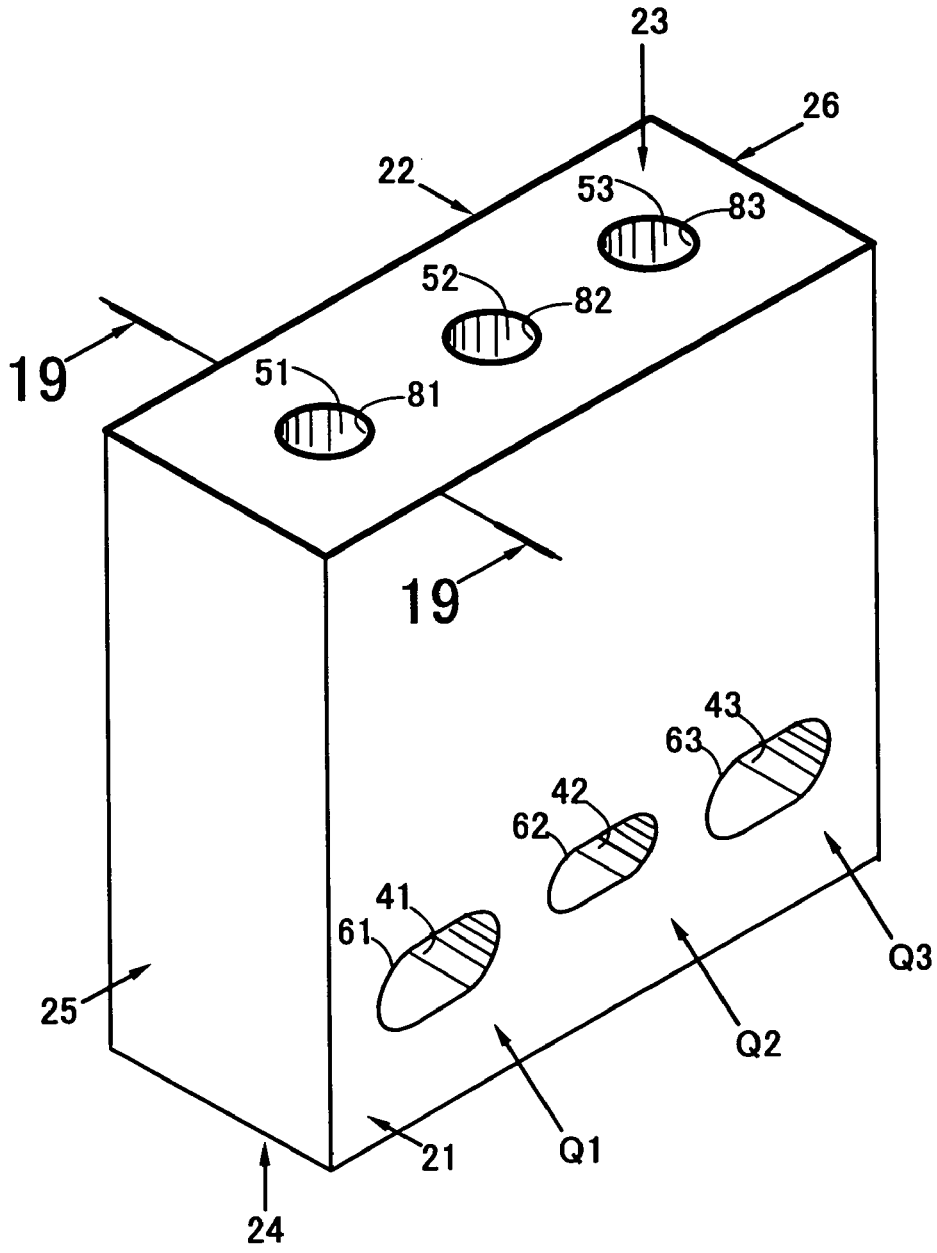
FIG. 18 is a perspective view of the dielectric device shown in FIG. 17, as seen from a rear side thereof.
Figure 19:
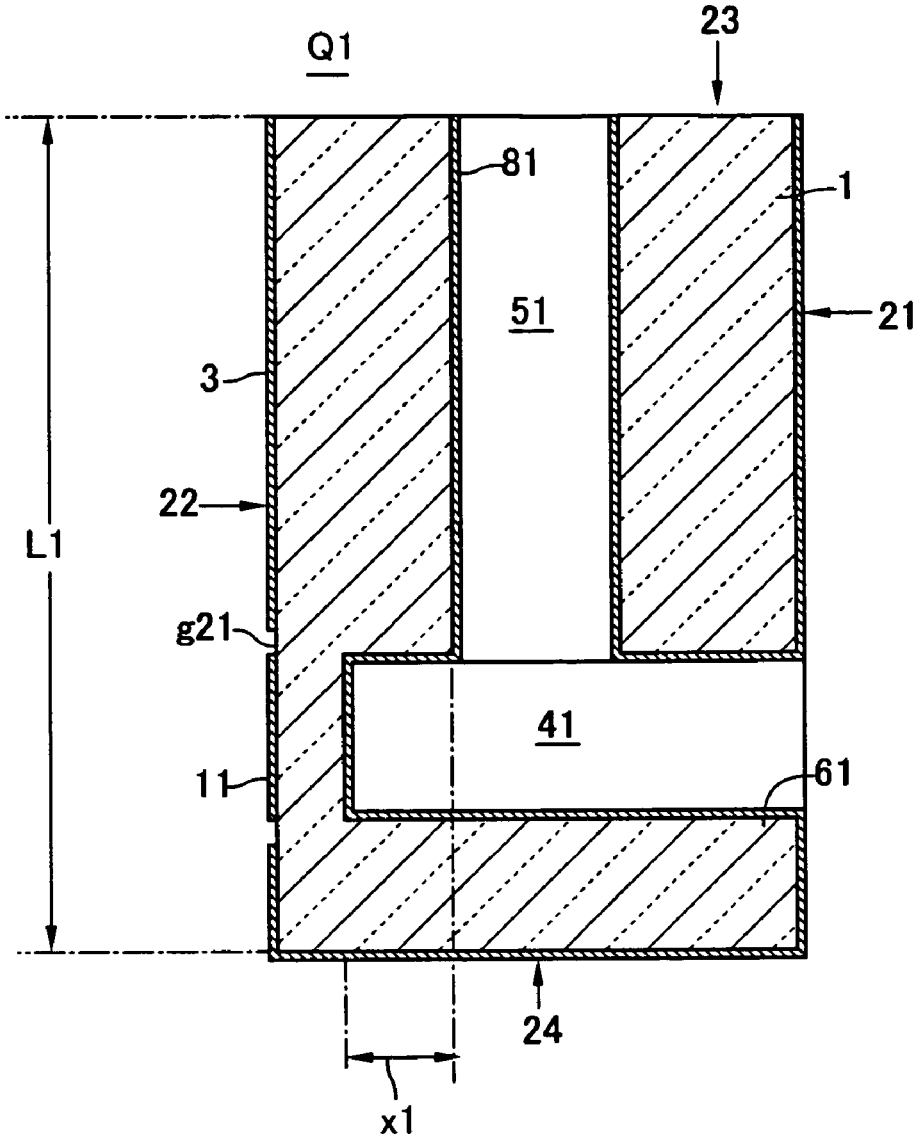
FIG. 19 is a cross-sectional view taken along line 19-19 in FIG. 18.

FIG. 17 is a perspective view of a dielectric device with three resonator units Q1, Q2, Q3 according to still another embodiment of the present invention; FIG. 18 is a perspective view of the dielectric device as seen from a rear side thereof; and FIG. 19 is a cross-sectional view taken along line 19-19 in FIG. 18. In the illustrated dielectric device, the first internal conductors 61, 62, 63 are connected to the external conductor film 3 on the first external surface 21. The third external surface 23, on which the second holes 51, 52, 53 and the second internal conductors 81, 82, 83 open, is not covered with the external conductor film 3. Therefore, the plane area of the third external surface 23 may be exploited to form a conductive pattern as a circuit element, thereby adjusting a coupling capacitance between the resonator units Q1, Q2, Q3 to obtain desired filter characteristics.

Figure 20:
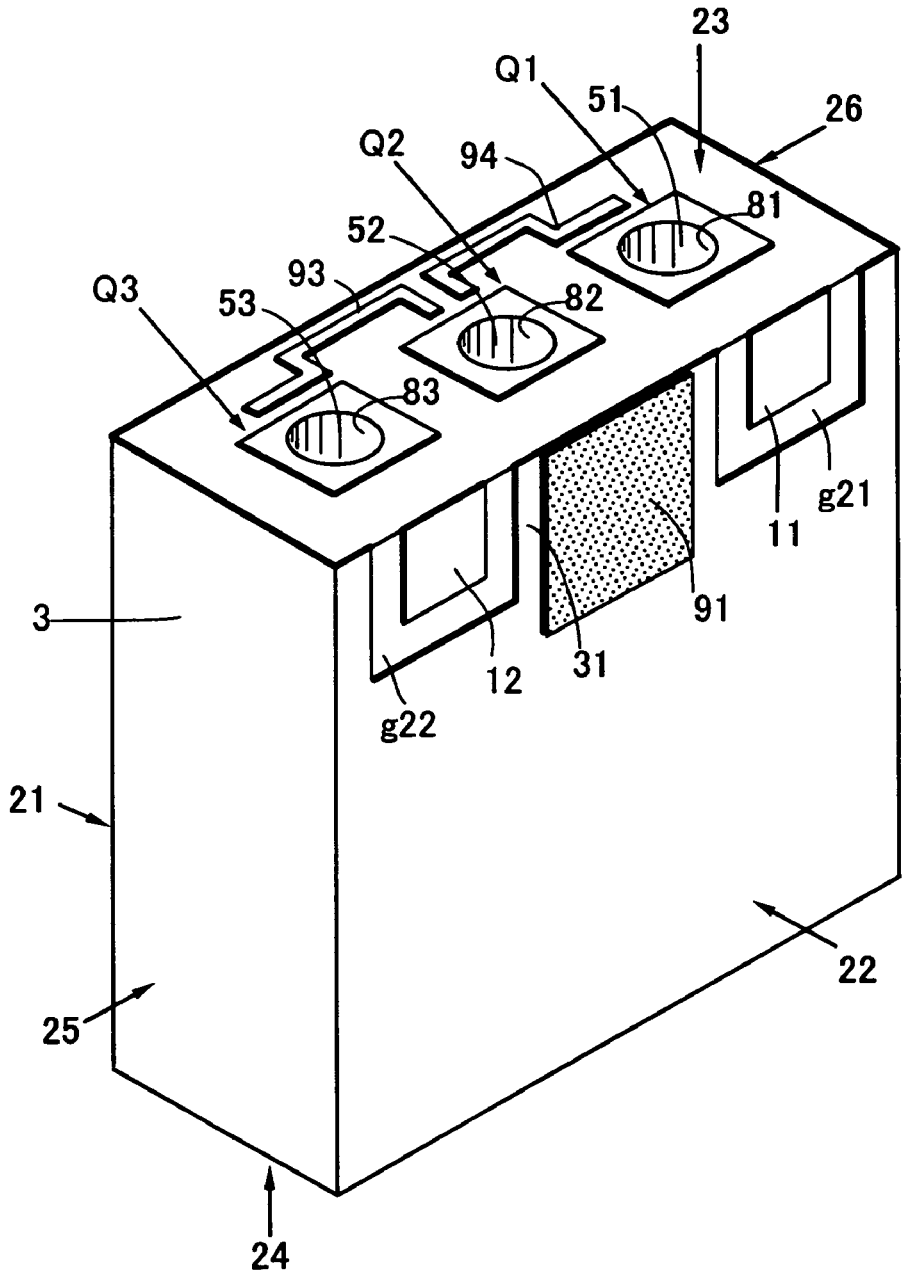
FIG. 20 is a perspective view of a dielectric device according to still another embodiment of the present invention.

Referring to FIG. 20, the first terminal 11 is disposed adjacent the third external surface 23, which is an open end surface, and opposed to the second hole 51 while being electrically isolated from the external conductor film 3 by the insulating gap 21. The second terminal 12 is also disposed adjacent the third external surface 23 and opposed to the second hole 53 while being electrically isolated from the external conductor film 3 by the insulating gap 22. Between the first and second terminals 11, 12, there is provided an intermediate conductor film 31, which is a part of the external conductor film 3.

Also in this embodiment, the intermediate conductor film 31 has an insulating film 91 thereon. When the dielectric device is mounted with the first and second terminals 11, 12 facing a circuit board, accordingly, filter characteristics such as pass band width can be adjusted by generating an attenuation pole at a desired frequency place in the vicinity of the pass band while hardly shifting a low-frequency attenuation pole. It is also possible to adjust an attenuation pole frequency by changing the relative length of the insulating film 91 to the first and second terminals 11, 12 and the width, thickness and material of the insulating film 91.

The circuit element to be formed on the third external surface (or open end surface) 23 may have a variety of patterns, as exemplified in FIG. 20. FIG. 20 is a perspective view of a dielectric device according to still another embodiment of the present invention. In this embodiment, circuit elements 94, 93 are separately formed in crank-like conductive patterns extending between the adjacent resonator units Q1, Q2 and between the adjacent resonator units Q2, Q3, respectively. The circuit elements 94, 93 are not limited to the crank-like patterns, but may be formed in curved patterns or straight patterns.

Figure 21:
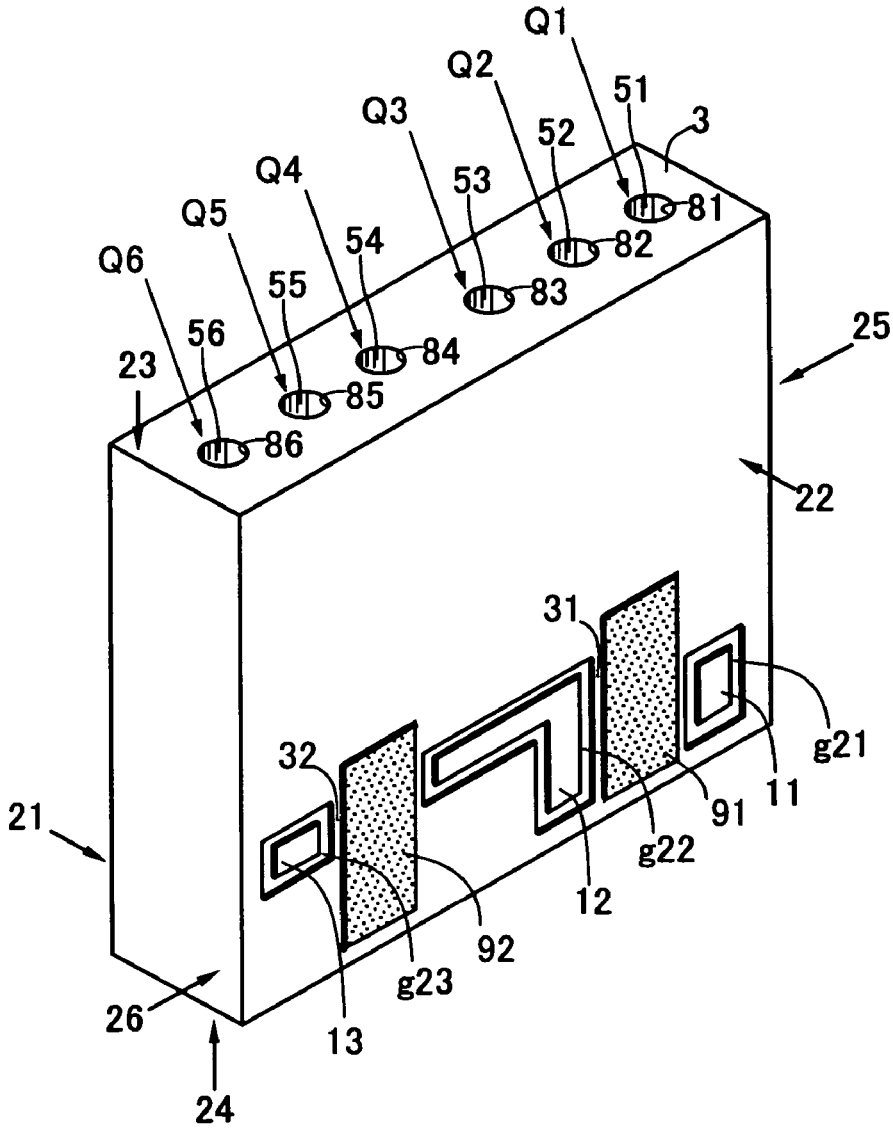
FIG. 21 is a perspective view of a duplexer according to still another embodiment of the present invention.
Figure 22:
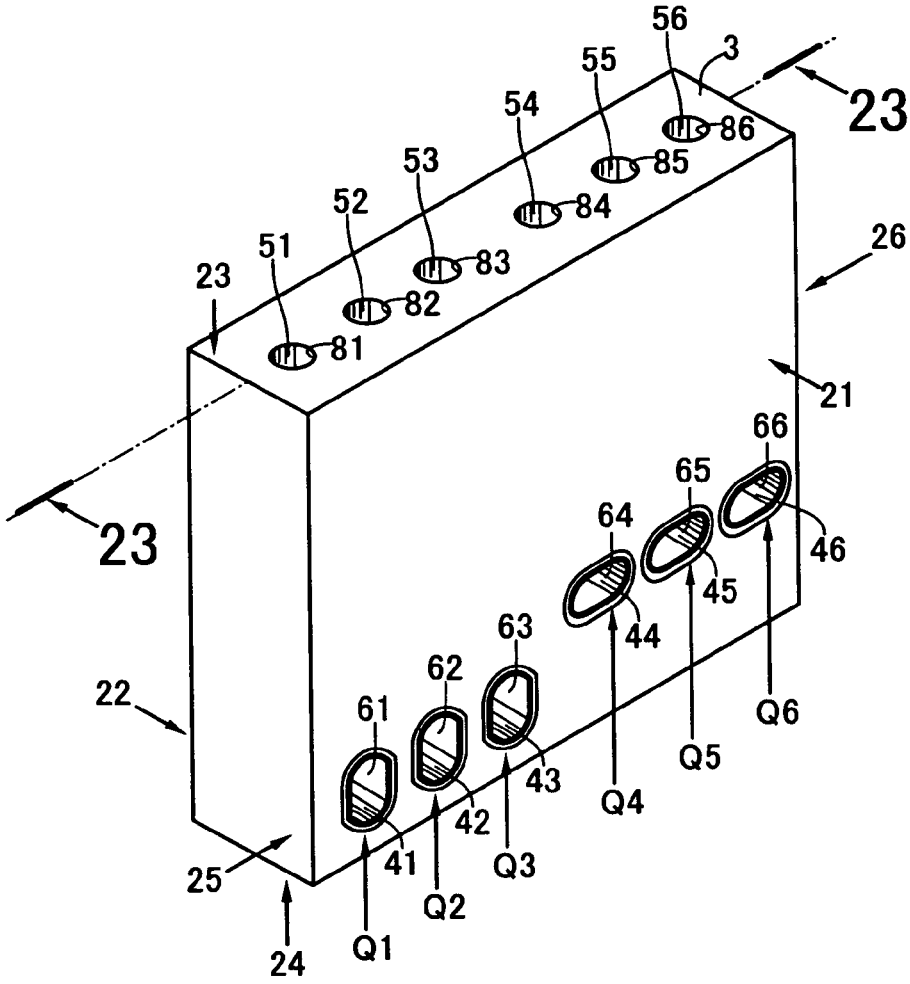
FIG. 22 is a perspective view of the duplexer shown in FIG. 21, as seen from a rear side thereof.
Figure 23:
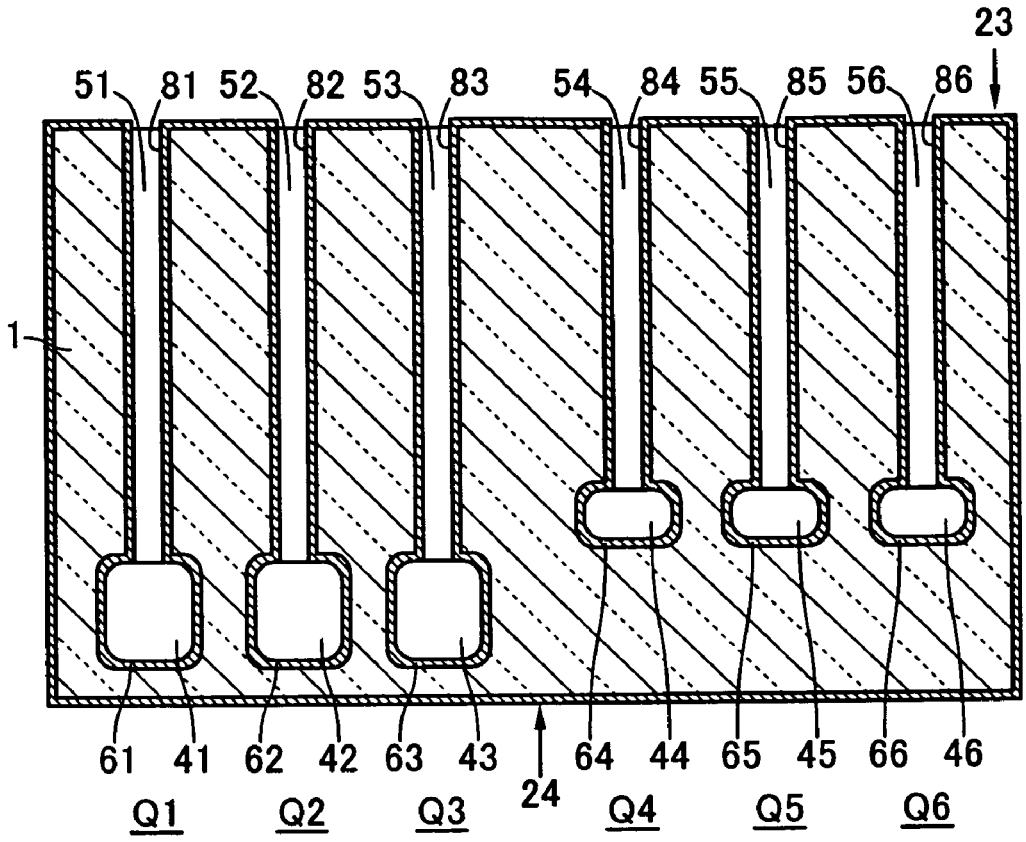
FIG. 23 is a cross-sectional view taken along line 23-23 in FIG. 22.

Next, there will be described a duplexer, which is another important application of the dielectric device according to the present invention. FIG. 21 is a perspective view of a duplexer according to still another embodiment of the present invention; FIG. 22 is a perspective view of the duplexer shown in FIG. 21, as seen from a rear side thereof; and FIG. 23 is a cross-sectional view taken along line 23-23 in FIG. 22. The illustrated duplexer includes six resonator units Q1 to Q6. The resonator units Q1 to Q6 share the dielectric substrate 1 and are integrated via the dielectric substrate 1. Of the dielectric substrate 1, most of the external surfaces, except the third external surface 23, are covered with the external conductor film 3.

Among the resonator units Q1 to Q6, the resonator unit Q1 includes a combination of first and second holes 41, 51, the resonator unit Q2 includes a combination of first and second holes 42, 52, and resonator unit Q3 includes a combination of first and second holes 43, 53; the resonator unit Q4 includes a combination of first and second holes 44, 54, the resonator unit Q5 includes a combination of first and second holes 45, 55, and resonator unit Q6 includes a combination of first and second holes 46, 56.

The first hole (41 to 46) and the second hole (51 to 56) may be configured and related to each other as described with reference to FIGS. 1 to 15. The first hole (41 to 46) has the first internal conductor (61 to 66), and the second hole (51 to 56) has the second internal conductor (81 to 86).

Since the duplexer is used as an antenna duplexer, either of two resonator unit groups (the resonator units Q1 to Q3 or the resonator units Q4 to Q6) is used for a transmitter, while the other group is used for a receiver. Since the transmit frequency and the receive frequency are different from each other, the resonance characteristics of the resonator units Q1 to Q3 and the resonance characteristics of the resonator units Q4 to Q6 also should be different from each other.

The resonator units Q1 to Q3 may be coupled together via a conductive pattern (or a circuit element). Here, a first terminal 11 is provided on the second external surface 22 and coupled with the first hole 41 of the resonator unit Q1 via the dielectric layer of the dielectric substrate 1.

The resonator units Q4 to Q6 may also be coupled together via a conductive pattern (or a circuit element). Here, a third terminal 13 is provided on the second external surface 22 and coupled with the first hole 46 of the resonator unit Q6 via the dielectric layer of the dielectric substrate 1. Such capacitive coupling has been described in detail hereinabove.

Furthermore, a second terminal 12 for connection with an antenna is provided on the second external surface 22 and coupled with the first holes 43, 44 of the central resonator units Q3, Q4.

The first to third terminals 11 to 13 on the second external surface 22 are electrically isolated from the external conductor film 3 by insulating gaps g21 to g23. The first to third terminals 11 to 13 ensure face-to-face attachment to a mounting board.

Between the first and second terminals 11, 12, there is provided an intermediate conductor film 31, which is a part of the external conductor film 3. Between the second and third terminals 12, 13, there is provided an intermediate conductor film 32, which is also a part of the external conductor film 3.

Also in this embodiment, the intermediate conductor film 31 has an insulating film 91 thereon, and the intermediate conductor film 32 has an insulating film 92 thereon. When the dielectric device is mounted with the first to third terminals 11 to 13 facing a circuit board, accordingly, filter characteristics such as pass band width can be adjusted by generating an attenuation pole at a desired frequency place in the vicinity of the pass band while hardly shifting a low-frequency attenuation pole. It is also possible to adjust an attenuation pole frequency by changing the relative length of the insulating films 91, 92 to the first to third terminals 11 to 13 and the width, thickness and material of the insulating films 91, 92.

Although not shown in the drawings, it will be appreciated the configurations described with reference to the dielectric filters shown in FIGS. 1 to 20 may also be adopted for a duplexer.

While the present invention has been particularly shown and described with reference to embodiments thereof, it will be understood by those skilled in the art that various changes in form and detail may be made therein without departing from the spirit, scope and teaching of the invention. For example, the first holes 41 to 46 of the resonator units Q1 to Q6 do not necessarily need to open on a common external surface. They may open on different external surfaces depending on the locations of the input/output terminals and the convenience of adjustment. If the fourth external surface 24 opposite to the third external surface 23 is not covered with the external conductor film 3, there can be obtained a $\lambda/2$ dielectric resonator.

What is claimed is:

1. An electronic device comprising:

a dielectric device; and a circuit board, the dielectric device including a dielectric substrate, a plurality of resonator units, and first and second terminals, said dielectric substrate including an external conductor film thereon, each of said resonator units including a hole and an internal conductor provided inside said hole and connecting with said external conductor film, said first terminal being provided on said dielectric substrate and electrically coupled with at least one of said resonator units, said second terminal being provided on said dielectric substrate and electrically coupled with at least another of said resonator units, a part of said external conductor film being provided directly between said first and second terminals, and the circuit board including the dielectric device mounted thereon such that the external conductor film is electrically connected to a ground conductor lying on the circuit board, and the first and second terminals are electrically connected to conductors lying on the circuit board separately, wherein an insulating film lies between the part of said external conductor film and the ground conductor.

2. An electronic device according to claim 1, wherein the part of said external conductor film includes the insulating film lying thereon.

3. An electronic device according to claim 2, wherein each of said resonator units includes first and second holes, said first hole being provided in said dielectric substrate, opening on a first external surface of said dielectric substrate, extending toward a second external surface of said dielectric substrate opposite to said first external surface, and including a first internal conductor therein, said second hole being provided in said dielectric substrate, opening on a third external surface of said dielectric substrate not opposite to said first external surface, connecting with said first hole inside said dielectric substrate, and including a second internal conductor therein, said second internal conductor connecting with said first internal conductor inside said dielectric substrate.

4. An electronic device according to claim 1, wherein a portion of the ground conductor lying opposite the part of said external conductor film includes an insulating film lying thereon.

5. An electronic device according to claim 1, wherein said insulating film is a glass film, a solder resist film, an organic insulating film, or an inorganic insulating film.

6. An electronic device according to claim 1, which is a dielectric filter or a duplexer.

7. An electronic device comprising:

a dielectric device; and a circuit board, the dielectric device including a dielectric substrate, a plurality of resonator unites, and first and second terminals, said dielectric substrate including an external conductor film thereon, each of said resonator unites including first and second holes, said first hole being provided in said dielectric substrate, opening on a first external surface of said dielectric substrate, extending toward a second external surface of said dielectric substrate opposite to said first external surface, and including a first internal conductor therein, said second hole being provided in said dielectric substrate, opening on a third external surface of said dielectric substrate not opposite to said first external surface, connecting with said first hole inside said dielectric substrate, and including a second internal conductor therein, said second internal conductor connecting with said first internal conductor inside said dielectric substrate, said first terminal being provided on said dielectric substrate and projecting therefrom, and being electrically coupled with at least one of said resonator units, said second terminal being provided on said dielectric substrate and projecting therefrom, and being electrically coupled with at least another of said resonator units, a part of said external conductor film being provided between said first and second terminals, and the circuit board including the dielectric device mounted thereon such that the external conductor film is electrically connected to a ground conductor lying on the circuit board, wherein the part of said external conductor film projects from the dielectric substrate to a lesser extent than the first and second terminals such that when the dielectric device is mounted on the circuit board the part of said external conductor film is spaced from the ground conductor.

8. An electronic device according to claim 7, which is a dielectric filter or a duplexer.

* * * * *